United States Patent [19]

Goldfarb et al.

[11] 3,995,859

[45] Dec. 7, 1976

[54] COMPETITIVE BOARD GAME AND MECHANICAL ENERGY-STORING CATCH-AND-PROPEL MECHANISM USABLE THEREWITH

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe

[22] Filed: Nov. 29, 1974

[21] Appl. No.: 528,014

[52] U.S. Cl. ..... 273/85 B; 124/6; 273/85 F; 273/129 C

[51] Int. Cl.[2] ..... A63F 7/10

[58] Field of Search ..... 273/119 R, 119 A, 119 B, 273/85 R, 85 A, 85 B, 85 C, 85 D, 95 H, 96 R, 108, 118 R, 118 D, 101, 95 R, 129, 127 C, 179 R, 179 A, 179 C; 124/16, 36, 7, 33, 37, 38, 39

[56] References Cited

UNITED STATES PATENTS

| | | | |
|---|---|---|---|
| 637,676 | 11/1899 | Shaw et al. | 273/119 A X |
| 977,149 | 11/1910 | Weeden | 273/119 R X |
| 3,172,665 | 3/1965 | Glass et al. | 124/36 X |
| 3,656,753 | 4/1972 | Juneau | 273/129 X |
| 3,866,917 | 2/1975 | Ensmann et al. | 273/129 X |

FOREIGN PATENTS OR APPLICATIONS

| | | | |
|---|---|---|---|
| 516,441 | 1/1953 | Belgium | 273/85 R |
| 1,380,734 | 10/1964 | France | 273/85 A |
| 508,532 | 1/1955 | Italy | 273/85 A |
| 679,021 | 12/1964 | Italy | 273/85 A |
| 6,400,594 | 7/1964 | Netherlands | 273/85 C |
| 1,155,495 | 6/1969 | United Kingdom | 273/85 A |

*Primary Examiner*—Anton O. Oechsle
*Assistant Examiner*—Arnold W. Kramer
*Attorney, Agent, or Firm*—Robert M. Ashen; Robert J. Schaap

[57] ABSTRACT

A competitive board game wherein two players propel a ball back and forth between them, each attempting to get the ball past his opponent. Each player has a mechanical energy-storing catch-and-propel mechanism which is coupled to the board for limited movement. When the ball is propelled toward a player, he attempts to catch it with his mechanism. The mechanism automatically returns the ball toward the player's opponent. Each catch and propel mechanism is manually cocked by a player after each discharge. The player directs the return to attempt to make it more difficult for the opponent to catch the ball. The play proceeds until someone misses. The players may be opposite one another with the board extending between them, or they may both face an upright wall against which the ball is rebounded. The ball is discharged automatically and essentially instantaneously each time it is caught by a mechanism. One illustrated form of the mechanism discharges the ball each time at a generally predetermined speed.

8 Claims, 10 Drawing Figures

COMPETITIVE BOARD GAME AND MECHANICAL ENERGY-STORING CATCH-AND-PROPEL MECHANISM USABLE THEREWITH

Games where opposing players compete by propelling a ball back and forth between them are of course well known and very popular. Such games include tennis, Ping Pong, handball, etc. Board type games which simulate such real games or activity have generally fallen into two categories: those where a movable flipper or simulated player is mounted atop a playing board and is manipulated either directly or through various mechanical linkages by the player to strike and thereby propel a ball, puck or the like. Such devices depend completely on the timing and control imparted by the player. In this regard, an experienced or older player may have a very strong advantage because of superior timing and the ability to manipulate the flipper to hit the object with great force. The younger or less experienced player is at a strong disadvantage and may become quickly bored with the game. This is particularly true of younger children who cannot effectively compete with older children or with adults. Another category of such games devices involves totally separated catch-and-propel units which may be moved anywhere over the surface of the board by the players. This arragement affords the players, especially younger children, with excessive leeway and the play of the game quickly develops into a wild melee; which usually results in the play of the game coming to a rapid halt with the players being upset and dissatisfied.

The present invention contemplates a competitive catch-and-propel board game which provides flexibility and movement to maintain the excitement and interest of the players, while providing determined limits on the action to prevent the play of the game from becoming uncontrolled and excessive. More particularly, the illustrated embodiment of the invention comprises generally a game board and a pair of mechanical, energy-storing catch-and-propel units or mechanisms for receiving and automatically returning a spherical object or play piece. Each of the illustrated units is movably mounted on the board for a limited translatory and angular movement, to permit the unit to catch the object propelled toward its goal or area and to permit the player to select the direction or angle of returning the object. The units may be positioned adjacent opposite ends of a board for directly propelling the object toward one another, or alternatively, the units may be spaced from an upright rebound wall whereby each player propels the object against the wall causing it to rebound toward his opponent. Thus, the movement of the units is controlled, as is the return propelling of the object. In the drawings:

Figure 1:
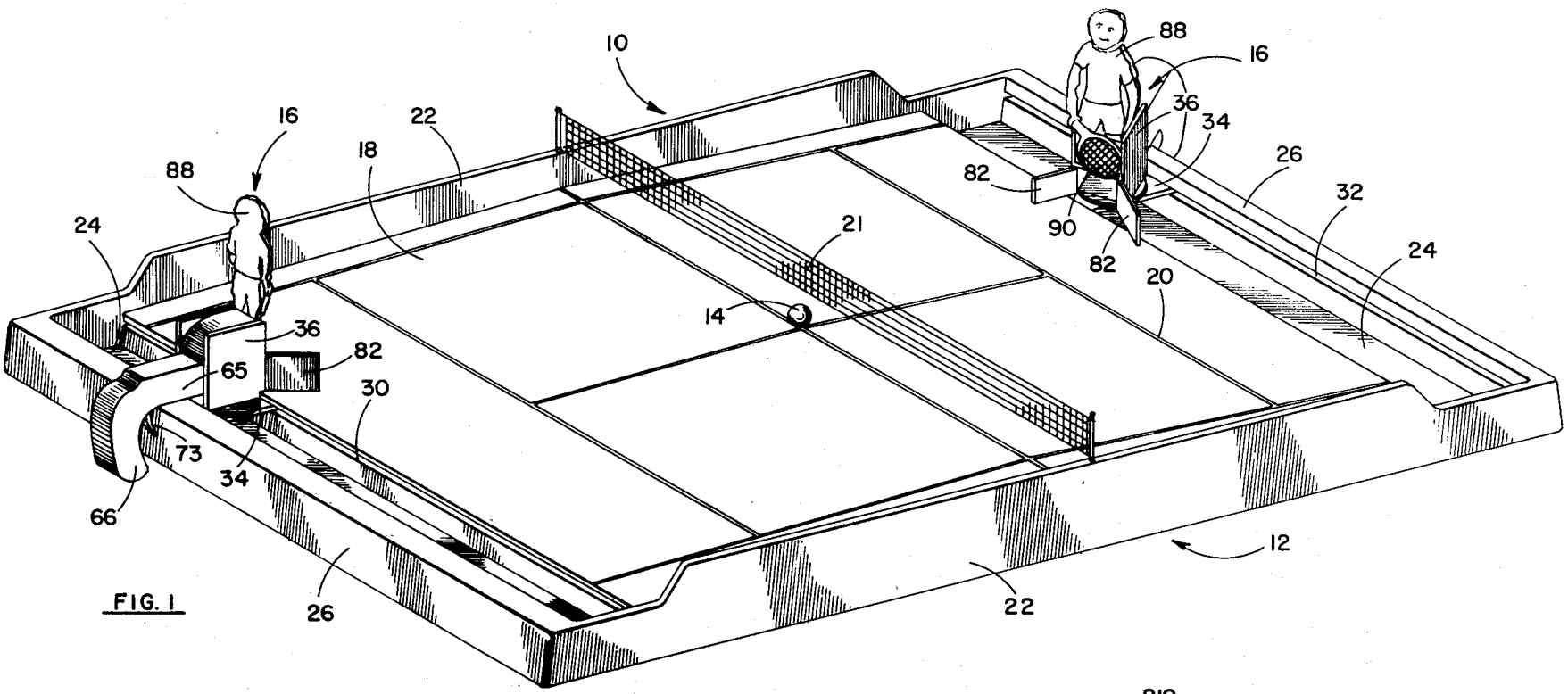
FIG. 1 is a perspective view of board game apparatus embodying a presently preferred form of the invention.

FIG. 1 discloses a competitive catch-and-propel board game apparatus 10 which comprises generally a gameboard 12, a spherical object or ball 14, and a pair of motorized mechanical catch-and-propel mechanisms or units 16 mounted on the board for limited movement with respect thereto.

Figure 1A:
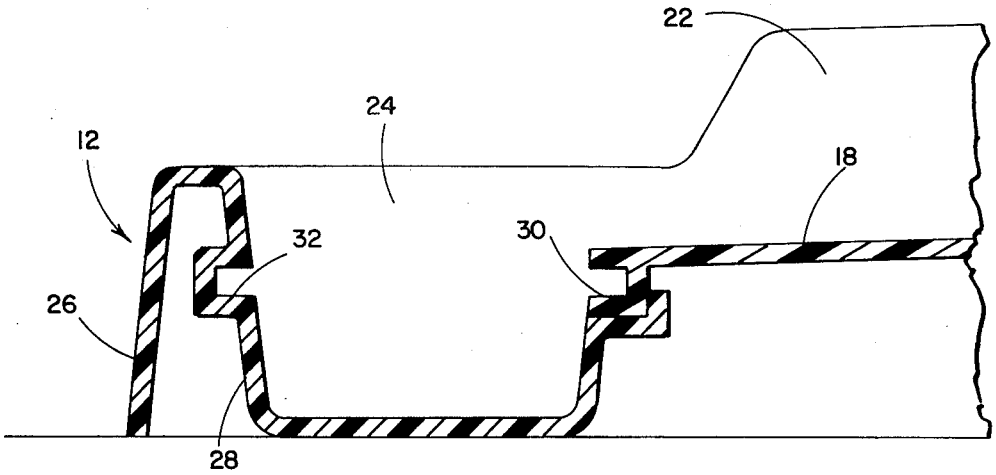
FIG. 1A is an enlarged sectional view taken at one end of the board of the apparatus.
Figure 3:
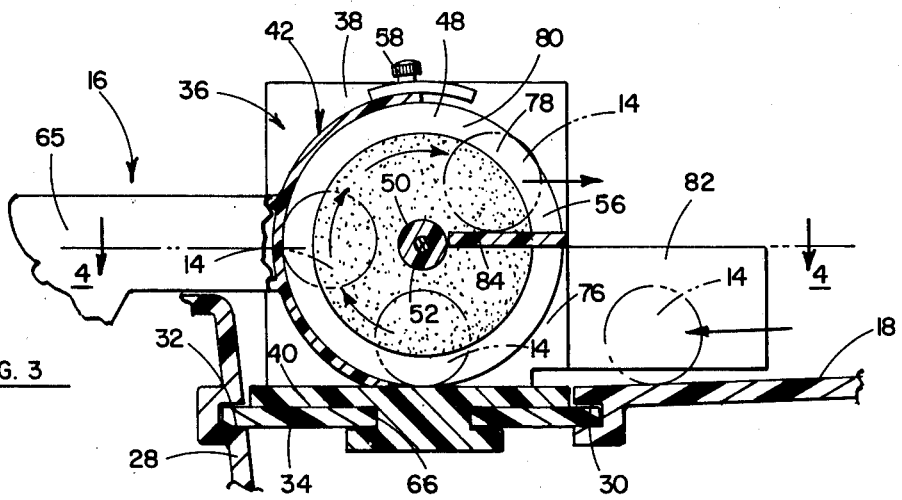
FIG. 3 is a side sectional view of one of the units, taken generally along line 3—3 of FIG. 2.
Figure 2:
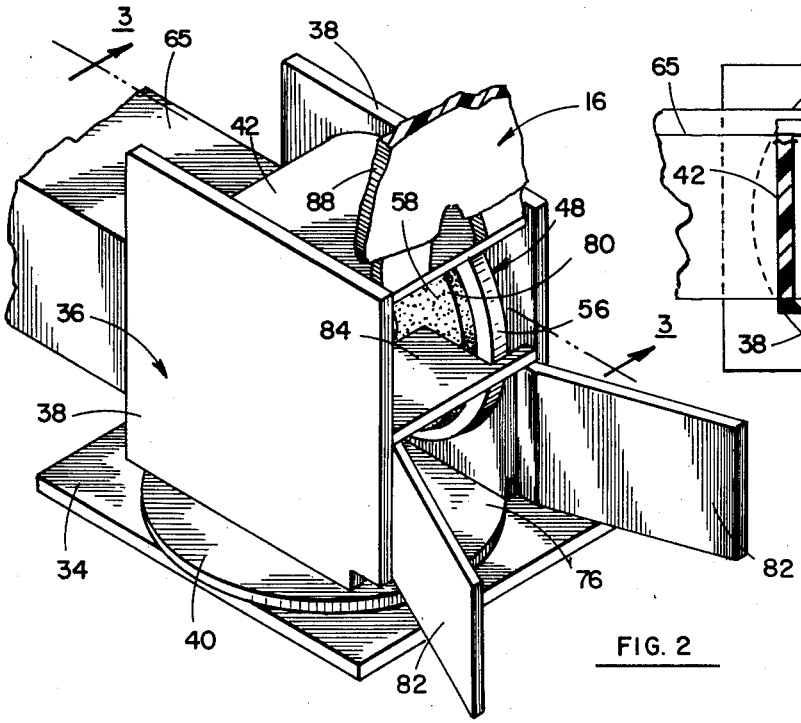
FIG. 2 is a perspective view of one of the catch-and-propel mechanisms or units of the apparatus.

Considering the illustrated apparatus 10 in further detail, gameboard 12, which may be made of plastic, wood, metal, paper, or other suitable material, is generally rectangular, having a substantially flat upper surface 18. The boad surface 18 may be slightly inclined from its center toward either end so that the ball will always roll toward one end or the other of the board rather than coming to rest at an intermediate position on the board. The illustrated surface 18 has indicia 20 thereon representing the lines of a "singles" tennis court. A simulated net 21 is also provided. It will be appreciated that the board may be made to represent the playing area for various other sports such as for example, Ping Pong, hockey, soccer, etc. The illustrated board includes a pair of upright, elevated side retaining walls 22, which extend above the playing surface 18 on either side thereof. The walls 22 serve to retain the ball 14 on the playing surface during play of the game. The board may be placed directly on a table or on the floor, or it may be elevated above such support surface by means of legs or the like (not shown). The illustrated board 12 is formed with a trough or a groove 24 extending transversely across either end of the board. One form of construction for the board 12 is shown in FIG. 1A. The side walls 22 and end walls 26 may be integrally formed as a single molded plastic part. At each end there is an internal wall section 28 having a bottom, a rearward and a forward wall that define the groove 24. The play surface 18 may be comprised by a separate horizontally disposed panel or plate of plastic, masonite, cardboard, or other suitable material, supported in the position shown in FIG. 1A. Each end edge of the play surface panel 18 may be provided with a transversely extending groove or recess 30, and the end wall section portion 28 may also be provided with a transversely extending groove 32. These grooves 30 and 32 are designed to receive the opposite edges of a support plate 34, to thereby movably support one of the catch-and-propel units 16 (FIG. 3).

Each of the units 16 comprises one of the support plates 34 and a generally rectangular housing 36 rotatably supported on the plate 34.

The illustrated housing 36 includes a pair of sidewalls 38, a circular bottom wall 40 and an arcuate or curved intermediate wall 42. The intermediate wall 42 extends between the sidewalls 38, starting at its lower end where it meets the bottom wall 40 at about the midpoint front-to-back of the bottom wall and extending through a circular arc of approximately 180° to the top of the housing 36.

A rotary carrier element or wheel 48 is rotatably supported within the housing 36 between sidewalls 38. The illustrated carrier 48 includes a central hub portion 50 which is rotatably disposed on a transverse shaft 52 secured between sidewalls 38. The carrier 48 also comprises a pair of disc portions 54, 56 which are mounted at either end of the hub portion 50 and adjacent the opposite sidewalls 38. In the illustrated embodiment, foam rubber circular pads 58 and secured to the inside surface of each of the disc portions 54, 56.

Figure 5:
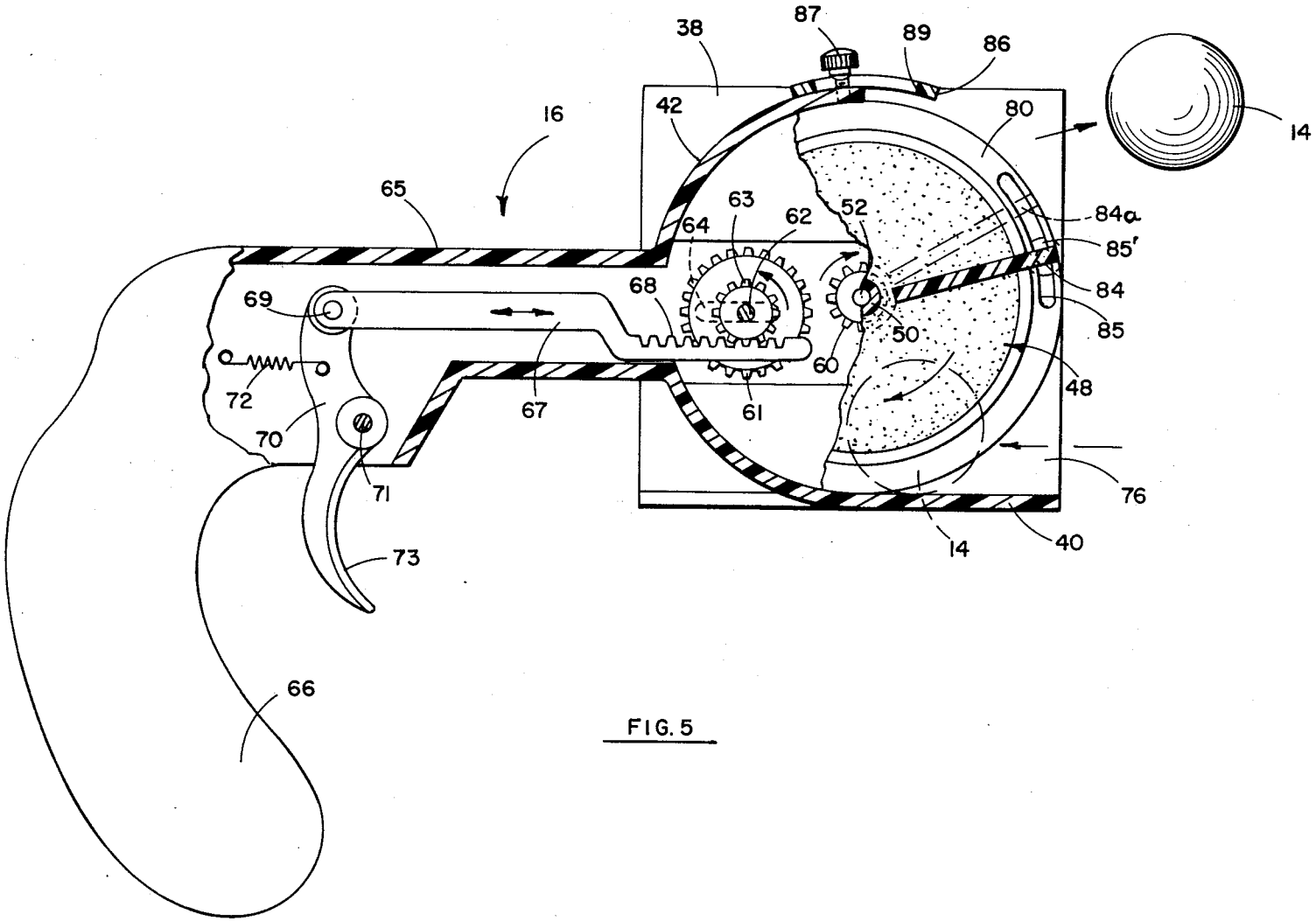
FIG. 5 is an enlarged side view, partially broken away and in section, of the mechanical catch-and-propel unit.

FIG. 5 illustrates somewhat schematically mechanical means for imparting energy to the inertia motor arrangement which rotates the rotary carrier 48. More particularly, a small gear 60 is fixed to an outward extension of the carrier hub portion 50 for driving engagement by larger driving gear 61 to rotate the carrier 48 as will be explained below. The driving gear 61 is mounted on a common shaft 62 with a smaller gear 63. The shaft 62 extends transversely of the housing from side to side and is received in a pair of horizontally extendng slots 64.

Manually operable powering means serve to rotate the gears 61 an 63 and to selectively move the driving gear 61 into and out of engagement with the carrier gear 60. The illustrated form of this manually operable driving means is a trigger-operated, spring-biased, reciprocating rack mechanism which will now be described in detail. The housing 36 includes a rearwardly extending extension portion 65 terminating at its rearward end in a pistol grip portion 66. Mounted within the extension portion 65 for front-to-rear reciprocating movement is an elongated horizontally extending member 67 having a rack portion 68 at its forward end. The rear end of the reciprocating member 67 is pivotally connected at 69 to the upper end of a trigger member 70 that is pivotally mounted at 71 within the extension housing portion 65. A spring 72 is connected between the upper portion of the trigger member 70 and the adjacent housing to spring bias the reciprocating member 67 rearwardly while also spring biasing the lower portion 73 of the trigger member 70 in the forward direction. The trigger portion 73 is located relative to the handle portion 66 so that the handle portion can be conveniently gripped by the user and the trigger porton 73 pulled by one or more fingers of the user's hand. When the trigger is pulled, the member 67 with the rack portion 68 is moved longitudinally forwardly to thereby effect driving movement of the gear 61. This driving movement comprises counter-clockwise rotation of the gear 61 together with forward movement of the gear 61 into meshing and driving engagement with the carrier gear 60. Thus, each time the trigger is pulled, driving gear 61 drives carrier gear 60 in the clockwise direction. This in turn drives the carrier 48 in the same clockwise direction. Each time the trigger is released, the spring 72 drives the reciprocating member 67 rearwardly and thereby disengages driving gear 61 from carrier gear 60. The user, by repeatedly pulling and releasing the trigger portion 73 will thereby impart clockwise rotation to the carrier 48 which will act as a flywheel or energy storing unit. Thus, an intertia motor arrangement is provided.

The ball 14 will be automatically returned at a speed determined by the speed at which carrier 48 is rotating. This speed of the carrier 48 will depend on the amount of energy supplied to it by the user. The ball 14 is returned automatically and generally instantaneously by the mechanism, without intervention or direct control at that moment by the player. In other words, since the player sets the carrier in motion before hand, when the ball is received, its return is at least in part an automatic function of the mechanism by virtue of the rotational energy stored in the carrier. While the return is very rapid, and characterized as generally instantaneous, a small amount of time is involved between the receipt and discharge of the ball which facilitates the player's ability to get the unit rotated to the desired angle.

As a variation from the embodiment of FIGS. 1–5, a spring-powered wind up motor could be provided to drive the carrier in lieu of the illustrated inertia motor.

Each of the housings 36 defines an entrance 76 for the receipt of the ball 14. The upper surface of the bottom wall 40 of the housing is generally level with the upper surface of surface plate 18 so that the ball will roll continuously from the surface 18 onto the wall 40. The entrance is further defined by the side walls 38. As shown best in FIG. 3, a ball which rolls from the surface 18 through the entrance 76 is received between the pads 58 of the carrier 48 and is carried as the carrier rotates to a discharge position such as illustrated at 78 in FIG. 3. The ball is then propelled outwardly through an exit 80 in a generally reverse direction from that at which it entered the unit.

Figure 4:
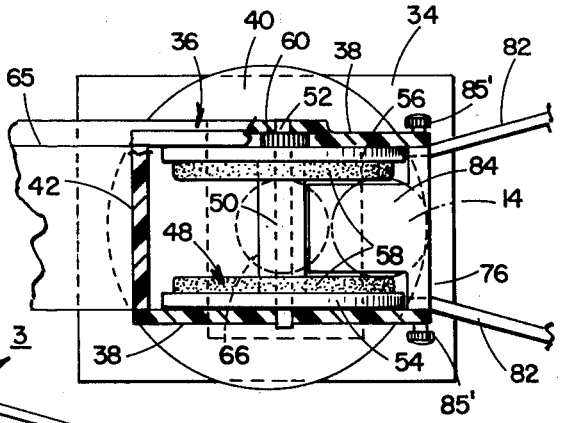
FIG. 4 is a top sectional view of one of the units, taken generally along line 4—4 of FIG. 3.

To facilitate the entry of the ball into the entrance 76 a pair of outwardly diverging guide or baffle plates 82, one at either side of the entrance 76, may be provided. To facilitate the discharge of the ball from the unit, a generally horizontal baffle plate 84 may be secured between sidewalls 38 at approximately the height of the axis of rotation of the carrier 48. A passageway is thus defined by the housing and the carrier for receipt, movement and subsequent discharge of the ball. The arrangement and proportioning of the parts of the housing and the carrier may be varied to provide the desired control and discharge of the ball. For example, the ball may be discharged at an upward angle rather than in the generally forward direction illustrated. This is desirable for a game such as tennis apparatus 10 to facilitate the ball 14 clearing the net 21. It may be desired to permit the players to lob their balls also. The angle of upward trajectory of discharge may be variable. Similarly, the ball may be angled downwad so as to bounce or roll over the surface 18. The net 21 is shown spaced above surface 18 to permit passage of such balls. More particularly, as shown in FIGS. 4 and 5, the baffle plate 84 may be made selectively positionable. The illustrated baffle plate 84 is shown with its radially outer end supported at either side of the housing in a generally arcuate slot 85 through which is tightenable clamping screw 85' may be varied to an alternate position such as shown in broken line at **84*a*. Further, an adjustable cover plate 86 is positionably mounted on the upper portion of the housing intermediate wall 42 as by means of a tightenable screw 87 which passes through a forwardly extending slot 89 in the cover plate 86 and screws into wall 42. The positons of the baffle and cover plate may be varied as desired to control the angle at which the ball 14** is discharged and its trajectory can thereby be controlled by the player.

The means and arrangement for receiving and gripping the ball by the rotary carrier may also be varied, which would in turn affect the discharging characteristics of the unit. Further, the weight and surface finish, as well as proportioning, of the ball will vary the effects produced.

A gripping handle 66 is used by the player to manipulate the unit. The player may move the unit transversely, and may also rotate it about its vertical axis.

The illustrated units 16 each include a representation 88 of a tennis player mounted upon the housing 36. The player 88 includes an arm and racket portion 90 having a free end which extends at least partially over the exit 80 of its unit. The arm and racket portion 90 may be of a flexible resilient plastic or the like or may be pivotably and resiliently mounted (not shown) so that when the ball is discharged from the exit 80, the arm and racket will move to give the impression that the player has hit the ball toward his opponent.

Figure 6:
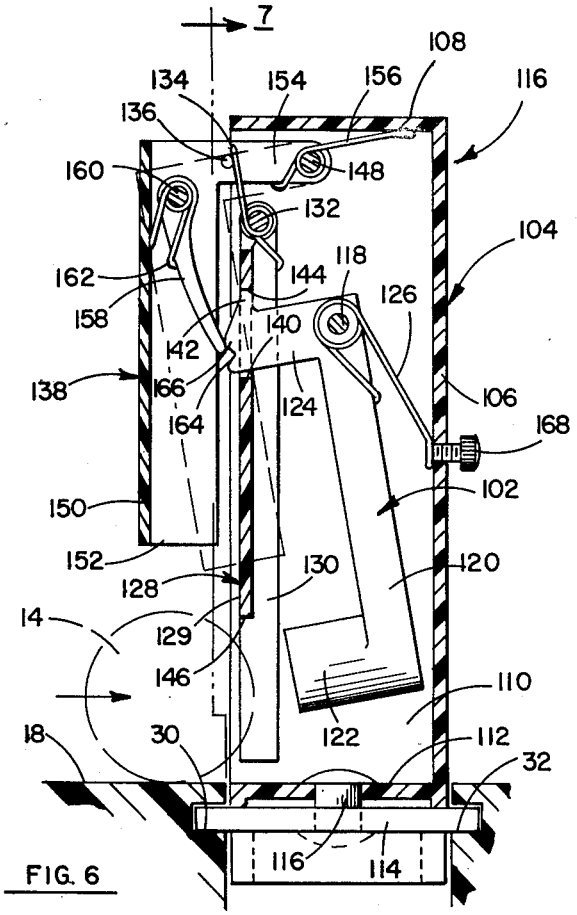
FIG. 6 is a side sectional view of a modified form of mechanical catch-and-propel unit, showing in broken line the setting position of the setting lever.
Figure 7:
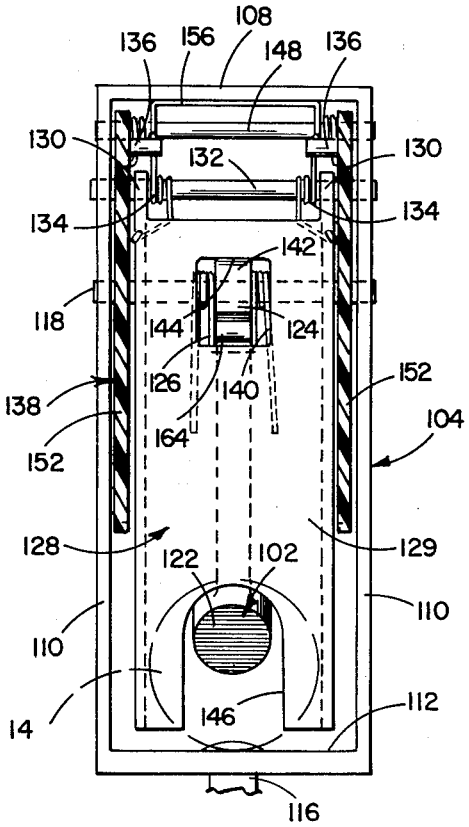
FIG. 7 is a sectional view taken generally along line 7—7 of FIG. 6.
Figure 8:
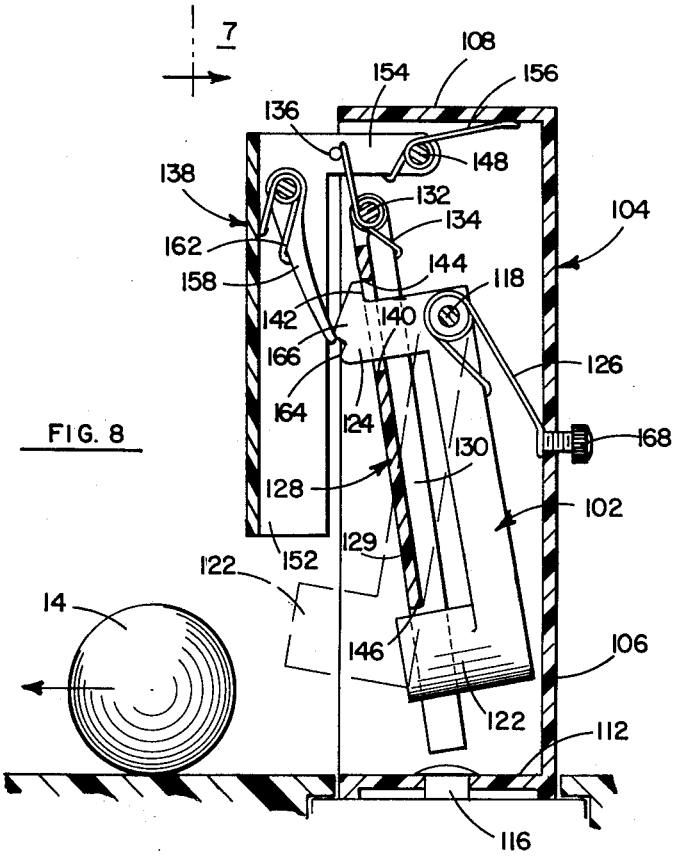
FIG. 8 is a side sectional view similar to FIG. 6, but illustrating the propelling position of the hammer in broken line.

FIGS. 6–8 show a modified form of motorized mechanical shooting or catch-and-propel mechanism 116. In general, each unit or mechanism 116 is manually preset so when the ball 14 is caught by the unit, a hammer 102 is released to thereby automatically propel the ball 14 outwardly toward the opponent. Each time the ball is propelled by the unit 116 it is at a generally constant speed independent of the skill or timing of the player.

More particularly, the unit 116 comprises a housing 104 which is generally rectangular, having a rear wall 106, a top wall 108, a pair of sidewalls 110 and a bottom wall 112. The front of the housng 104 is open. The housing 104 is mounted on a horizontal plate 114 which may be supported in a pair of spaced apart grooves in the game board 18 comparable to grooves 30 and 32 of the embodiment of FIGS. 1–5. Thus, the unit 116 may be moved transversely of the board as with the other embodiment. Further, housing 104 may be pivotally mounted on the plate 114 for rotation about a vertical axis as by means of a vertically extending connector or rivet 116 which passes through housing bottom wall 112 and plate 114.

The hammer 102 is pivotally supported on a transverse shaft 118 for pivotable movement between a set or withdrawn position shown in solid lines in FIGS. 6 and 8 and a forward or striking position shown in broken line in FIG. 8. The illustrated hammer 102 comprises an elongated vertically disposed mid-section 120, an impact or head section 122 which is secured to the lower end of the mid-section 120 and extends forwardly therefrom, and an upper section 124 connected to the upper end of mid-section 120 and extending forwardly therefrom. The head section 122 may have a circular or other suitble cross-section for applying an impact to the ball 14. A wire spring 126 is mounted on the transverse shaft 118 so that a portion of the spring bears against the hammer 102 and the ends of the spring bear against the rear wall 106 of the housing to thereby urge the hammer forwardly to the broken line position in FIG. 8.

FIG. 6 shows the hammer 102 held in its set position by a latch plate 128. Latch plate 128 has a generally vertically extending main plate portion 129 supported and positioned extending across the open front face of the housing 104. The plate portion 129 has at each side edge a rearwardly directed side flange portion 130. The upper ends of the flange portions 130 extend above the main plate portion 129 for rotatably supporting the latch plate 128 on a transversely extending shaft 132. A pair of wire springs 134 are disposed on the shaft 132, with each of the springs 134 being disposed adjacent inwardly of the upwardly extending end of one of the flange portions 130. The springs 132 engage the plate member 128 and a pair of stop pins 136 on a resetting lever 138 to urge the latch member 128 to the forward latching position shown in FIG. 6.

The latch portion 129 has a generally rectangular opening 140 adjacent its upper end and central thereof from side to side for receiving therethrough the upper section 124 of the hammer 102. With the unit in the set position shown in FIG. 6, the hammer section 124 has an upwardly extending tab 142 which engages the upper edge 144 of the opening 140 in the latch plate 128 to hold the hammer 102 in that set position. The latch plate portion 129 also includes a cut-out portion 146 adjacent its lower end for passage of the hammer head section 122 therethrough for engagement with the ball 14. The illustrated cut-out 146 is located centrally from side to side of the lower end of the plate portion 129, extending up from that lower end.

FIG. 6 shows the ball 14 in broken line about to engage the lower portions of the latch plate member 128. It will be noted that the cut-out 146 is sufficiently small to prevent the ball from passing therethrough without engaging and thereby moving the latch plate 128. The impact of the ball 14 against the latch plate 128 pivots its lower end rearwardly to toward the position shown in FIG. 8. This thereby disengages the retaining edge 144 from the tab 142 of the hammer 102. The hammer 102 is thereby free to be urged forwardly by the spring 126 to the broken line position shown in FIG. 8. When the hammer is released and swings forwardly, it imparts a blow to the ball, projecting the ball outwardly generally in the direction shown by the arrow in FIG. 8. Thus, the device, including the spring 126, comprises a mechanical motor arragement for storing energy for powering the hammer to strike the ball.

Setting or latching of the hammer 102 is accomplished by gripping and squeezing the setting lever 138. The lever 138 is pivotally mounted in the housing 104 on a transversely extending shaft 148. More particularly, the lever 138 comprises a generally rectangular front portion 150 and a pair of rearwardly extending side flange portions 152. At the upper end of each of the flange portions 152, there is a rearwardly extending tab portion 154. The rearward ends of the tab portions 154 are rotatably mounted on the transverse shaft 148. The setting lever 138 is proportioned so that the side flange portions 152 and the tabs 154 fit within the side walls 110 of the housing and pass outwardly on either side of the latch plate 128. A wire spring 156 mounted on the shaft 148 engages the tab portions 154 and the upper wall 108 of the housing to urge the setting lever 138 to the solid line position shown in FIGS. 6 and 8. A movable setting arm 158 is rotatably mounted at its uppr end on a transverse shaft 160 extending between the side flange portions 152 of the setting lever 138. The arm 158 is disposed centrally of the device from side to side so that it will extend through the opening 140 of the latch plate 128. A spring 162 mounted on the shaft 160 engages the arm 158 and the front wall 150 of the lever 138 to bias the arm 158 in the counter clockwise direction as viewed in FIGS. 6 and 8. The lower end of the arm 158 is configured and positioned to engage a lip 164 on the upper hammer section 124 when the setting lever 138 is squeezed and rotated in the counterclockwise direction. This rotates the hammer 102 in the counterclockwise direction to the set position shown in solid lines in FIGS. 6 and 8; this rotates the tab 142 on the hammer 102 to a somewhat lowered position so that it will clear the edge 144 which in turn permits the latch plate 128 to be biased in the clockwise direction to the solid line position shown in FIG. 6. The latch plate 128 thereby holds the hammer 102 in the set position.

It will be noted that there is a small projection 166 on the forward end of the hammer upper section 124 just above the lip 164. This projection 166 serves to release the lower end of the setting arm 158 from the lip 164. In this connection, once the hammer 102 has been sufficiently rotated to the set position, its projection 166 engages the arm 158 and rotates it clockwise against its spring 162 to achieve that release. Then when the setting lever 138 is released, it will return to the position shown in FIGS. 6 and 8 in solid line. The hammer 102 is held in the set position by the latch plate 128 and the arm 158 is now positioned relative to the lip 164 so that the arm 158 will not interfere with the forward impacting motion of the hammer 102. The amount of impact imparted by the hammer 102 to the ball 14 may be selectively pre-set at difference values to thereby cause the ball to be propelled from the unit at different speeds. In this connection, as shown in FIGS. 6 and 8, an adjusting screw 168 may be provided in the housing rear wall 106 adjacent the spring 126 to vary the spring force exerted by spring 126 on the hammer 102. For each pre-setting, each return of the ball would be approximately the same speed.

Figure 9:
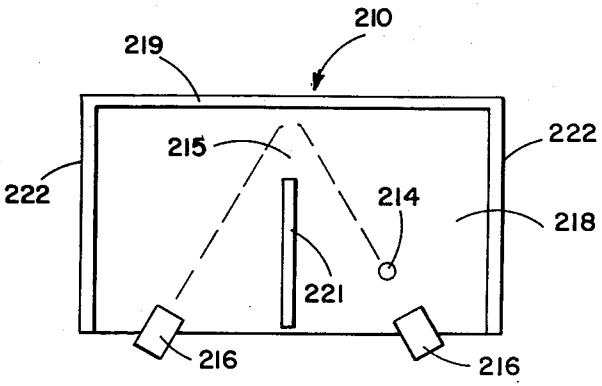
FIG. 9 shows schematically an alternate form of game apparatus.

FIG. 9 shows a schematic plan view of an alternate form of game apparatus 210. Apparatus 210 comprises a rectangular playing surface 218 having a pair of upright side barrier walls 222 and an upright rear rebound wall 219. An upright partial mid-barrier wall 221 may be provided to divide the playing surface into two areas, one for each player. Each player may also be provided with a mechanical energy-storing catch-and-propel mechanism 216 (which may be like one of these described above). Each mechanism 216 may be mounted at the edge of the play surface 218 opposite the rebound wall 219, for translatory movement along that edge on its side of the mid-barrier 221. The mechanisms 216 may also pivot about vertical axes. The mid-barrier is only partial, leaving a space 215 between its rear end and the rebound wall 219 for passage of the ball 214. Thus, each player tries to catch the ball when it comes into his area and propel it against the wall 219 so that it will pass through the space 215 and into the opponent's area. Play proceeds until someone misses.

Various other modifications and changes may be made in the illustrated structures without departing from the spirit and scope of the invention as set forth in the claims. As a particular example, the housing and rotary carrier or wheel construction shown in FIGS. 1–5 could be modified so that instead of the carrier rotating continuously, it instead rotates intermittently to act as an energy-storing spring-loaded rotary hammer which operates similarly to the construction of FIGS. 6–8. In this connection the carrier could be set or cocked between propelling operations against a spring that acts to rotate the carrier from the entrance to the exit of the housing. When the ball enters the entrance, the carrier is released (as by the ball engaging a latch) to carry the ball around to the exit from where it is propelled outwardly. Portions of the carrier thus act essentially as a rotary hammer, impacting the ball and propelling it outwardly.

We claim:

1. A competitive mechanical catch-and-propel board game comprising:

a. a board having an upper playing surface and spaced apart player areas;

b. a spherical object movable over the playing surface; and c. a pair of mechanical energy-storing catch-and-propel devices operatively associated with said game board, each device having a body portion and a mechanism mounted on the body portion to receive and automatically return the spherical object, each of said devices being disposed at one of said player areas and being adapted for at least translatory movement relative to the playing surface and for angular movement from side to side relative to said playing surface to vary the angle at which the object is returned, each of said mechanisms comprising an energy-storing power means, manually actuable cocking means to cock and thereby store energy in said energy-storing means, a release means operatively associated with said cocking means to release said energy-storing means from said cocking means, said release means having a trigger member positioned to be engaged and moved by said spherical object to actuate said release means to release said energy-storing means, and a striker member operatively associated with said energy-storing means and movable upon release of said energy-storing means to engage said spherical object and to propel said object toward the other player area essentially instantaneously upon contact of said spherical object with said trigger member, said cocking means being manually actuable after each actuation of said release means.

2. The game of claim 1 wherein said board has a pair of opposed ends which constitute said player areas and said devices are each located at respective ones of said opposed ends.

3. The game of claim 2 further comprising means defining upright retaining walls at the sides of the board and goals at each of the opposed ends of the board.

4. The game of claim 3 wherein each of said goals comprises an elongated trough extending substantially from side to side of the board.

5. A competitive mechanical catch-and-propel board game comprising:

a. a board having a playing surface and opposed areas;

b. a spherical object movable over the playing surface;

c. a pair of mechanical catch-and-propel devices for receiving and automatically returning the spherical object, each of said devices having a housing and a mechanism in the housing comprising a mechanical motor means for storing energy for returning the spherical object, each of said devices having a coupling means and said board having a cooperating coupling means so that each of said devices may be individually and separately located at one of said areas on said board for translatory and rotational movement relative to said board and to the other device; and d. each of said catch-and-propel mechanisms comprising said energy-storing mechanical motor means, manually actuable cocking means to cock and maintain said motor means in an energy-storing condition, means including a movable trigger member which is actuable to release said motor means from said cocking means and a movable striker member operatively associated with said motor means for being moved to engage and propel said spherical object toward the opposed area essentially instantaneously upon contact of said spherical object with said trigger member, said cocking means being manually actuable after each actuation of said trigger member.

6. The game of claim 5 wherein the mechanical motor means of each of said mechanisms comprises a spring operated motor.

7. The game of claim 5 wherein each of said mechanisms is characterized in that:

said striker member comprises a hammer movably supported in the housing to strike the spherical object;

said mechanical motor means comprises spring motor means in the housing urging the hammer from a set position toward a striking position;

said cocking means comprises a latch means on the housing for engaging the hammer to releasably hold it in the set position against the spring motor means; and said trigger member is located on the housing and positioned to be engaged by the spherical object to release the hammer from the latch means.

8. The game of claim 7 further including means on the housing for selectively pre-setting the urging force exerted by the spring motor means on the hammer at different values.

* * * * *